US011530589B2

(12) United States Patent
Hallundbæk

(10) Patent No.: US 11,530,589 B2
(45) Date of Patent: Dec. 20, 2022

(54) DOWNHOLE TOOL

(71) Applicant: WELLTEC A/S, Allerød (DK)

(72) Inventor: Jørgen Hallundbæk, Zug (CH)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 17/211,127

(22) Filed: Mar. 24, 2021

(65) Prior Publication Data

US 2021/0301616 A1 Sep. 30, 2021

(30) Foreign Application Priority Data

Mar. 25, 2020 (EP) ..... 20165642

(51) Int. Cl.

| | |
|---|---|
| ***E21B 31/16*** | (2006.01) |
| ***E21B 10/26*** | (2006.01) |
| ***E21B 10/40*** | (2006.01) |
| ***E21B 10/64*** | (2006.01) |
| ***E21B 31/107*** | (2006.01) |
| ***E21B 31/20*** | (2006.01) |

(52) U.S. Cl.

CPC ..... *E21B 31/16* (2013.01); *E21B 10/26* (2013.01); *E21B 10/40* (2013.01); *E21B 10/64* (2013.01); *E21B 31/107* (2013.01); *E21B 31/20* (2013.01)

(58) Field of Classification Search

CPC ..... E21B 10/02; E21B 10/26; E21B 31/00; E21B 31/02; E21B 31/16; E21B 31/20

See application file for complete search history.

(56) References Cited

U.S. PATENT DOCUMENTS

| | | | | |
|---|---|---|---|---|
| 8,201,632 | B2 | 6/2012 | Burnett | |
| 2010/0101802 | A1* | 4/2010 | Hallundbaek | E21B 10/26 175/58 |

(Continued)

FOREIGN PATENT DOCUMENTS

| | | |
|---|---|---|
| AU | 2016368616 | 6/2019 |
| EP | 2 314 825 | 4/2011 |

OTHER PUBLICATIONS

Extended Search Report for EP 20165642.8, dated Sep. 23, 2020, 8 pages.

(Continued)

*Primary Examiner* — David Carroll
(74) *Attorney, Agent, or Firm* — Nixon & Vanderhye P.C.

(57) ABSTRACT

The present invention relates to a downhole tool for removing a restriction in a well tubular metal structure having a wall and an inner diameter, the restriction partly blocking the inner diameter, creating an opening defined at least partly by a rim section of the restriction, the downhole tool having a tool axis and comprising a tool body having a first part and a second part, an electrical motor arranged in the first part for rotating a rotatable shaft, a core bit arranged in the second part and having a first end connected with the rotatable shaft and a second end having a cutting edge, wherein the second part of the downhole tool further comprises a locator for locating the rim section, a collecting means for collecting part of the restriction to be cut out by the cutting edge, the locator and the collecting means are rotating with the core bit until the locator locates the rim section and a threshold value is reached.

17 Claims, 4 Drawing Sheets

(56) References Cited

U.S. PATENT DOCUMENTS

Figure 1:
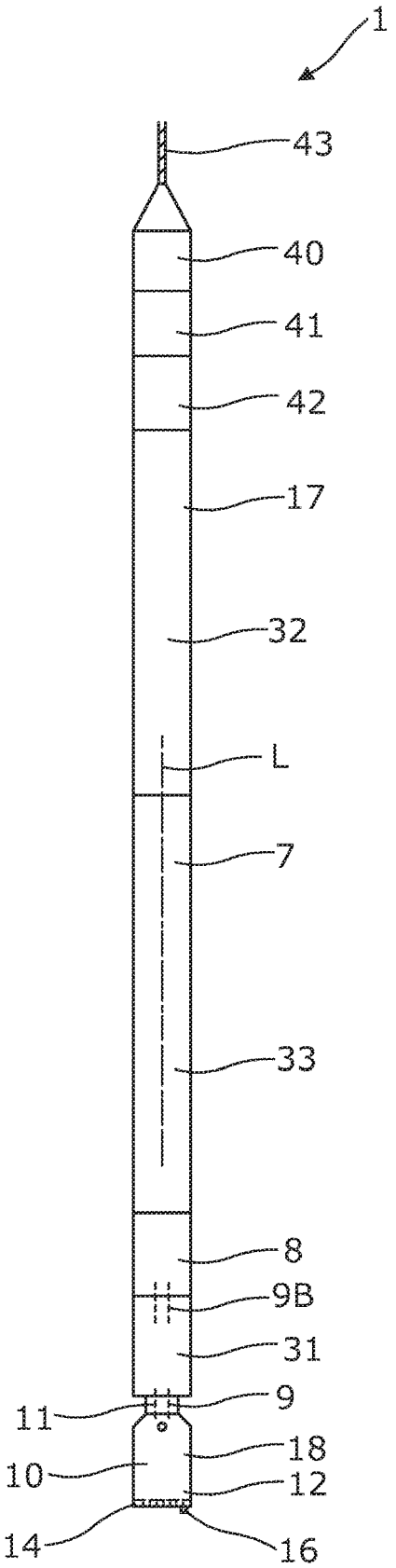

| | | | | |
|---|---|---|---|---|
| 2010/0288485 | A1* | 11/2010 | Blair | E21B 29/002 166/99 |
| 2017/0159385 | A1* | 6/2017 | Krüger | E21B 29/10 |
| 2018/0179845 | A1 | 6/2018 | Pallin et al. | |
| 2019/0218875 | A1 | 7/2019 | Zhang | |
| 2019/0316443 | A1* | 10/2019 | Haugland | E21B 27/02 |

OTHER PUBLICATIONS

International Preliminary Report on Patentability dated Oct. 6, 2022 in International Application No. PCT/EP2021/057581, 8 pages.

* cited by examiner

DOWNHOLE TOOL

This application claims priority to EP Patent Application No. 20165642.8 filed 25 Mar. 2020, the entire contents which is hereby incorporated by reference.

The present invention relates to a downhole tool for removing a restriction in a well tubular metal structure having a wall, a tool axis and an inner diameter, the restriction partly blocking the inner diameter, creating an opening defined at least partly by a rim section of the restriction.

Downhole intervention tools are used in an existing well for drilling out a restriction in the casing, e.g. reboring a stuck valve.

Occasionally, a downhole valve which has been closed for some time gets stuck, due to corrosion or the like, and thus cannot be reopened with the usual equipment. In such situations, drilling out part of the stuck valve is the only solution in order to gain full access therethrough and thus regain a full-bore casing. When reboring the stuck valve, the drill bit tends to slide on the abutting surface, especially if the valve is a ball valve, and thus the drill bit has a pilot bit in the centre, and the cut-out part of the stuck valve is also retrieved with the drill bit by means of the pilot bit, such as known from EP2314825. However, sometimes the valve gets stuck when being half-closed/opened, resulting in an opening across the centre, and then a pilot bit can no longer be used for avoiding sliding and for retrieving the cut-out part of the valve after the drilling operation has been completed. Furthermore, the cut-out part of the valve can also not be retrieved from the well.

It is an object of the present invention to wholly or partly overcome the above disadvantages and drawbacks of the prior art. More specifically, it is an object to provide an improved downhole tool which is able to retrieve a restricting part of a half-closed valve or other damaged component from the well to regain access to the well below the valve.

The above objects, together with numerous other objects, advantages and features, which will become evident from the below description, are accomplished by a solution in accordance with the present invention by a downhole tool for removing a restriction in a well tubular metal structure having a wall, a tool axis and an inner diameter, the restriction partly blocking the inner diameter, creating an opening defined at least partly by a rim section of the restriction, comprising:

- a tool body having a first part and a second part,
- an electrical motor arranged in the first part for rotating a rotatable shaft, and
- a core bit arranged in the second part and having a first end connected with the rotatable shaft and a second end having a cutting edge, wherein the second part of the downhole tool further comprises:

- a locator for locating the rim section, and
- a collecting means for collecting part of the restriction to be cut out by the cutting edge, the locator and the collecting means are rotating with the core bit until the locator locates the rim section and a threshold value is reached.

By having the locator and the collecting means rotating with the core bit until the locator locates the rim section of the restriction and a threshold value is reached, the locator can enter the opening of e.g. a half-closed valve, and the collecting means also entering the opening can fasten the cut-out part of the restriction so that the cut-out part is brought to surface along with the tool after the operation has ended. The cut-out part may obstruct the well tubular metal structure, and it is therefore important that it is removed along with the tool and does not remain in the well. Thus, the downhole tool is able to cut out the part of the valve restricting access to the well and retrieve this part of the half-closed valve from the well to regain access to the well below the valve.

The core bit rotates during the cutting operation and creates a cut along its circumference, and the locator and the collecting means stop rotating when the locator is prevented from rotation by the restriction.

By "cutting" is also meant milling out part of a restriction, e.g. a valve or similar damaged component in the well. The milling process is an abrasive process.

The core bit may have a centre axis coincident with the tool axis.

Moreover, the locator and the collecting means may be rotating with the core bit in a first condition, and in a second condition the locator and the collecting means may stop rotating with the core bit.

Also, the locator and the collecting means may be rotating with the core bit in a first condition, and in a second condition the locator and the collecting means may be prevented from rotating with the core bit by the rim section of the restriction.

In addition, the locator and the collecting means may be rotating with the core bit in a first condition, and in a second condition where the locator contacts the rim section the locator and the collecting means may stop rotating with the core bit.

Furthermore, the locator and the collecting means may be connected with the core bit until a predetermined force is reached, i.e. a threshold value is reached, between the locator and the core bit.

Also, the locator and the collecting means may be releasably connected with the core bit.

Additionally, the locator and the collecting means may be connected with the core bit by a frictional force, and the locator and the collecting means may be disconnected from the core bit when the locator is prevented from rotating with the core bit, overcoming the frictional force. The locator is prevented from rotating when the locator hits against the rim section of the opening.

Moreover, in a first condition the core bit may be configured to rotate mutually with the locator and the collecting means, and in a second condition the core bit may be configured to rotate relatively to the locator and the collecting means.

Further, the second condition may be activated when the locator contacts the rim section of the restriction.

Also, the core bit may have a centre axis, and the locator is arranged radially offset from the centre axis.

Furthermore, the core bit may have a centre axis, and the locator may be arranged off-centre from the centre axis.

In addition, the core bit may have a centre axis, and the locator may have a locator axis, which locator axis may be arranged off-centre from the centre axis.

Also, the core bit may have a centre axis, and the locator may have a locator axis which is arranged at a distance in a radial direction away from the centre axis.

By having the locator arranged radially offset from the centre axis, the locator is able to locate the opening of e.g. the half-closed valve and thus guide the collection means into the opening in order to be able to retrieve the cut-out part of the restriction. The opening of a partly closed valve often does not overlap the centre of the core bit, and by arranging the locator off-centre from the centre of the core bit, the locator is thus able to locate the rim section of the opening even if the opening does not overlap the centre of the tool and the centre of the core bit. The same applies when the locator is arranged off-centre from the centre axis, or when the locator has a locator axis which is arranged at a distance in a radial direction away from the centre axis.

In addition, the locator and the collecting means may be arranged within the core bit.

Furthermore, the second part may comprise a base part and a spring arranged between the locator and the base part so that the locator compresses the spring when moving along the tool axis towards the first end of the core bit.

Moreover, the locator may be moved along the tool axis by the restriction when the core bit moves along the tool axis and cuts into the restriction.

The locator has a first condition in which the locator is in its extended position and a second condition in which the locator has moved in relation to the core bit by an external force such as from contacting the restriction. Hereby, the locator compresses the spring as the locator is forced by the external force to move towards the first end of the core bit along the tool axis.

Also, the spring may have an extension along the tool axis.

Additionally, the locator and the collecting means may be fixedly connected.

Furthermore, the locator and the collecting means may be fixedly connected for guiding the collection means in through the opening arranged off-centre from the tool axis.

Moreover, the locator and the base part may be fixedly connected.

In addition, the core bit may comprise a ball bearing arranged between the core bit and the base part.

Further, the core bit may be connected with the locator by means of a fastening means, such as a coupling, a shear part or a spring-loaded pin, until the threshold value is reached.

Also, the coupling may be a friction coupling or a torque coupling.

Moreover, the coupling may be arranged between the base part and the core bit.

Additionally, the fastening means may be arranged between the base part and the core bit.

Furthermore, the core bit may have an indentation for receiving the spring-loaded pin.

In addition, the core bit may have a centre axis, the collecting means being arranged radially offset from the centre axis.

Also, the collecting means may comprise at least one bendable part for engaging the cut-out part of the restriction.

Moreover, the collecting means may comprise at least one expandable/projectable part for being expanded/projected when passing the opening for supporting the cut-out part of the restriction so that it is held in place between the core bit and the expandable/projectable part.

Additionally, the collecting means may have a radial extension being larger than that of the opening.

Further, the locator may project from the cutting edge along the tool axis. In that way, it is easier to apply a force on the locator and reach the threshold value to release the locator from the core bit.

In addition, the locator may have a first locator end connected with the core bit and a second locator end having a tapering shape.

Furthermore, the collecting means may extend radially from the locator.

The downhole tool may further comprise a gearing section connected between the electrical motor and the rotatable shaft for reducing the rotation of the core bit in relation to the rotational output of the motor.

Also, the downhole tool may further comprise an axial force generator providing an axial force along the tool axis.

Moreover, the axial force generator may be arranged in the first part for moving the second part along the tool axis.

The downhole tool may further comprise an anchoring tool section for preventing the tool from rotating within the casing.

Further, the anchoring tool section may comprise projectable anchoring elements.

In addition, the downhole tool may further comprise a driving unit, such as a downhole tractor, for preventing the tool from rotating within the casing and for providing an axial force along the tool axis.

Furthermore, the downhole tool may be a wireline tool, i.e. a downhole wireline tool.

Additionally, the driving unit may comprise a second motor driving a second pump for rotating wheels and projecting arms onto which the wheels are arranged.

Finally, the downhole tool may comprise a compensator for providing a surplus pressure inside the downhole line separation tool.

Figure 4:
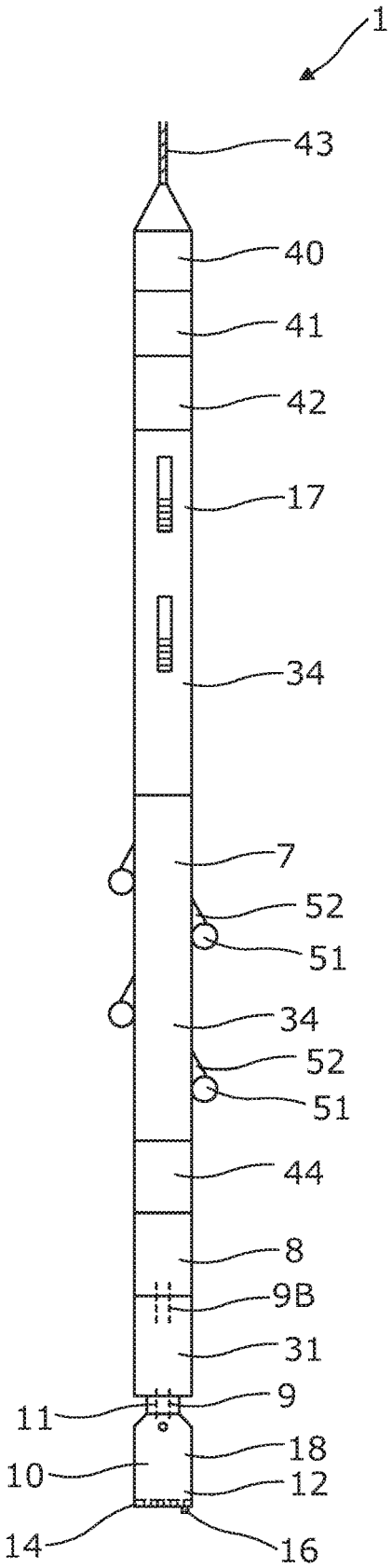
Figure 2:
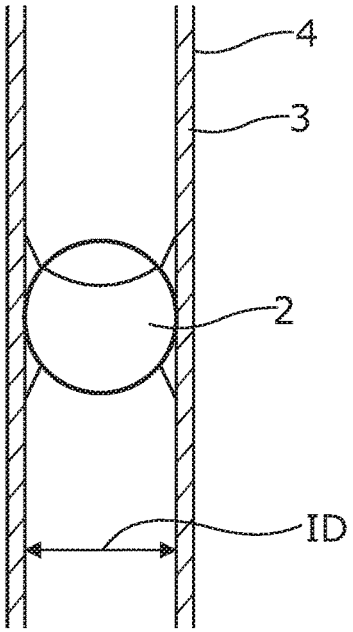
Figure 3:
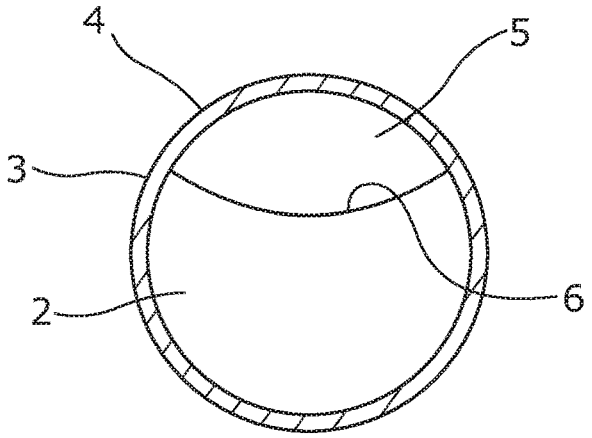
Figure 10:
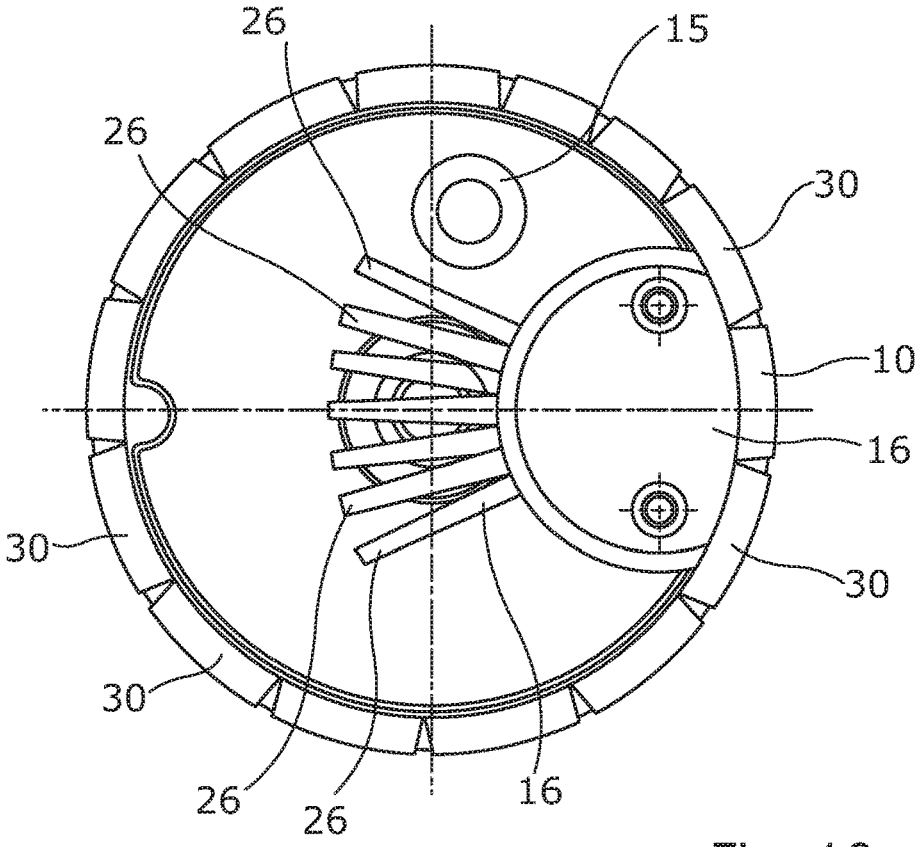
Figure 5:
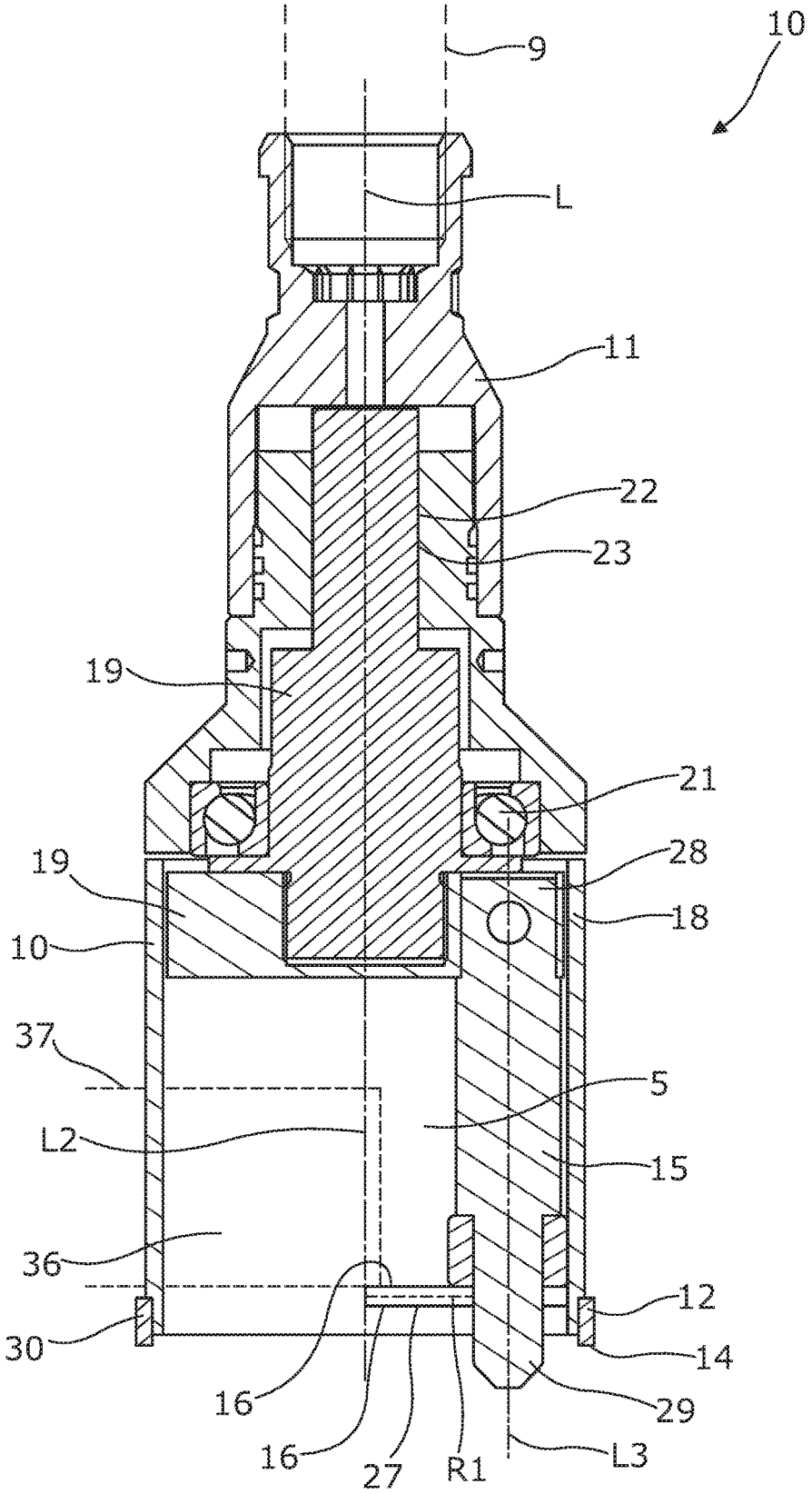
Figure 6:
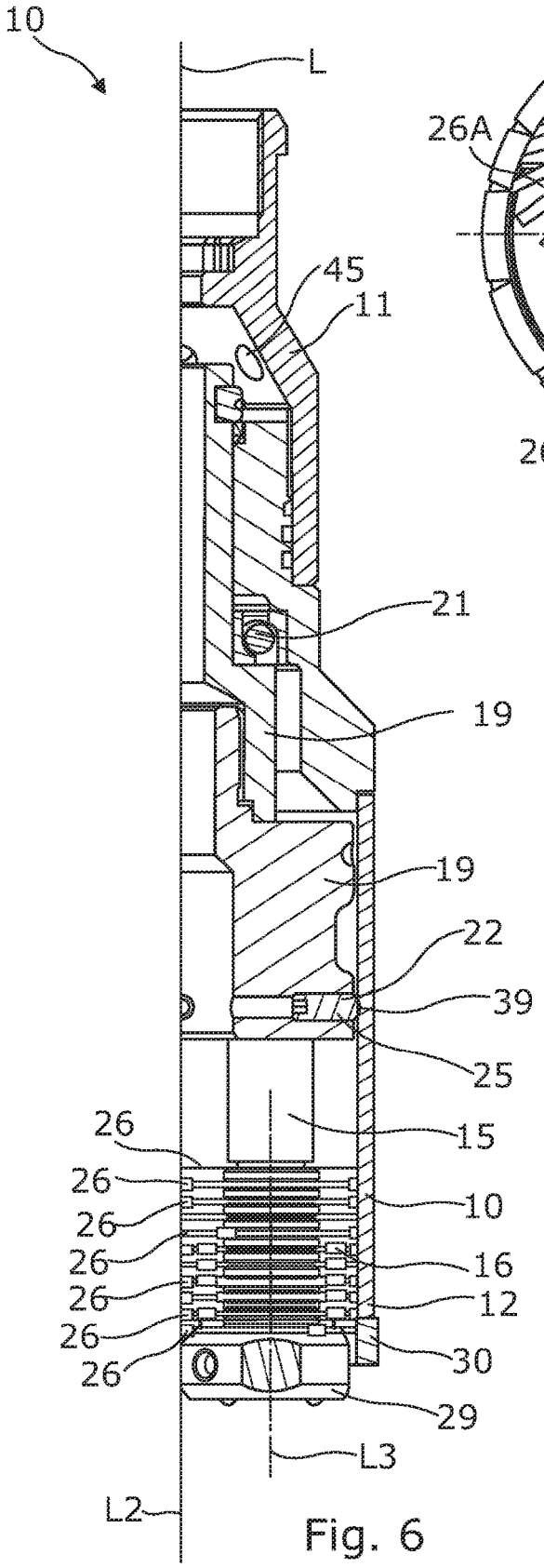
Figure 7:
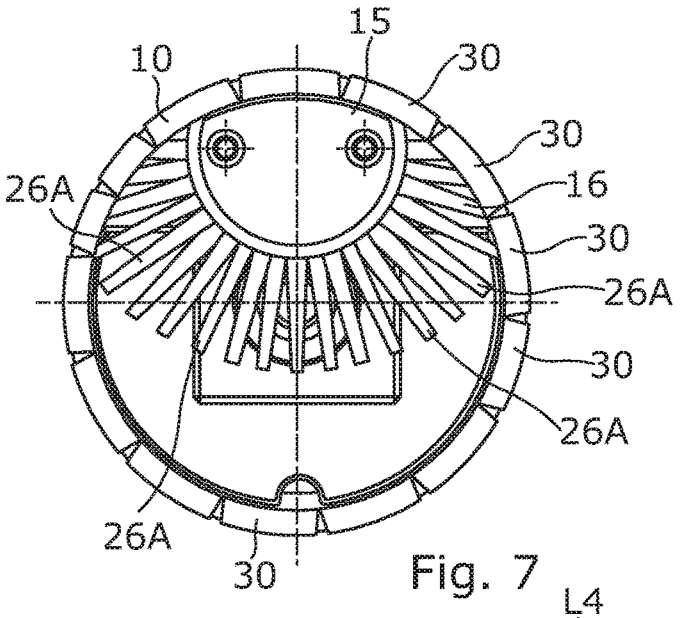
Figure 8:
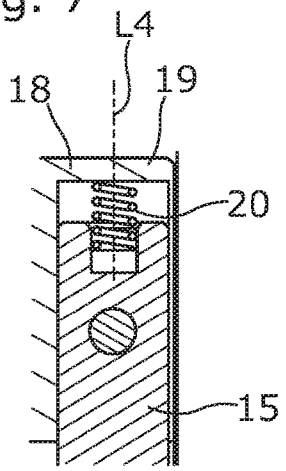
Figure 9:
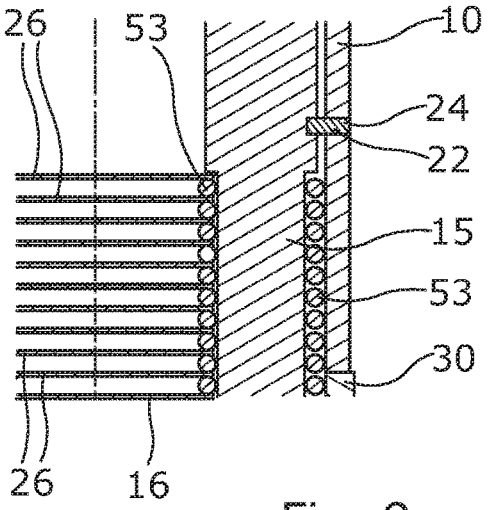

The invention and its many advantages will be described in more detail below with reference to the accompanying schematic drawings, which for the purpose of illustration show some non-limiting embodiments and in which:

FIG. 1 shows a downhole tool according to the invention,

FIG. 2 shows a restriction, such as a ball valve being half-closed, in a well tubular metal structure downhole, FIG. 3 shows a cross-sectional view of the well tubular metal structure illustrating the half-closed ball valve of FIG. 2 and the offset opening, FIG. 4 shows another downhole tool according to the invention, FIG. 5 shows a cross-sectional view of the second part of the downhole tool, FIG. 6 shows a cross-sectional view of the second part of another downhole tool, FIG. 7 shows another embodiment of the downhole tool seen from the cutting edge, FIG. 8 shows a partly cross-sectional view of a spring between a locator and a base part of the downhole tool, FIG. 9 shows a partly cross-sectional view of a locator fixedly fastened to a collecting means, and FIG. 10 shows another embodiment of the downhole tool seen from the cutting edge.

All the figures are highly schematic and not necessarily to scale, and they show only those parts which are necessary in order to elucidate the invention, other parts being omitted or merely suggested.

FIG. 1 shows a downhole tool 1 for removing a restriction 2, as shown in FIG. 2, in a well tubular metal structure 3. The well tubular metal structure 3 in FIG. 2 has a wall 4 and an inner diameter ID. The restriction may be a ball valve, as shown in FIGS. 2 and 3, being partially closed and thereby partly blocking the inner diameter, creating an opening 5 defined at least partly by a rim section 6 of the restriction.

The downhole tool 1 shown in FIG. 1 comprises a tool axis L and a tool body 7 having a first part 17 and a second part 18. The downhole tool 1 further comprises an electrical motor 8 arranged in the first part for rotating a rotatable shaft 9 and a core bit 10 arranged in the second part and having a first end 11 connected with the rotatable shaft and a second end 12 having a cutting edge 14 for cutting into the restriction. The second part 18 of the downhole tool further comprises a locator 15 for locating the rim section and a collecting means 16 (shown in FIG. 5) for collecting a cut-out part 36 of the restriction 2 after being cut out by the cutting edge 14. The locator 15 and the collecting means 16 are rotating with the core bit 10 until the locator locates the rim section and a threshold value is reached.

By having the locator and the collecting means rotating with the core bit until the locator locates the rim section and a threshold value is reached, the locator can enter the opening, and the collecting means can fasten the cut-out part of the restriction so that the cut-out part is brought to surface along with the tool after the operation has ended. The cut-out part may obstruct the well tubular metal structure, and it is therefore important that it is removed along with the tool and does not remain in the well. Thus, the downhole tool is able to cut out the part of the valve restricting access and retrieve part of the half-closed valve from the well to regain access to the well below the valve.

As shown in FIG. 5, the core bit has a centre axis L2, and the locator 15 has a locator axis L3 which is arranged radially offset from the centre axis. The locator 15 rotates with the core bit, and both the core bit 10 and the locator 15 are forced forward towards the restriction in the well while rotating. When the locator hits against the rim section 6, the locator is prevented from further rotation, and as the core bit keeps rotating the threshold value is reached, and the locator stops rotating and is disconnected from the rotating core bit. The primary function of the locator is to guide the collecting means 16 into the opening so that the cut-out part of the restriction is fastened between the collecting means 16 and the core bit, and so that the cut-out part of the restriction can be retrieved from the well.

By having the locator arranged radially offset from the centre axis, the locator is able to locate the opening of the half-closed valve and thus guide the collection means into the opening in order to be able to retrieve the cut-out part of the restriction. The opening of a partly closed valve often does not overlap the centre of the core bit, and by arranging the locator off-centre from the centre of the core bit, the locator is thus able to locate the rim section of the opening. The same applies when the locator is arranged off-centre from the centre axis, or when the locator has a locator axis which is arranged at a distance in a radial direction away from the centre axis.

The locator has a first locator end 28 connected with the core bit and a second locator end 29 having a tapering shape. When the second locator end 29 of the locator 15 hits against the rim section 6 (shown in FIG. 3), the locator is prevented from further rotation, and as the core bit keeps rotating the threshold value is reached, and the locator stops rotating and is disconnected from the rotating core bit. The cutting edge 14 of the core bit is provided by bits or inserts 30 which cut into the restriction until a cut-out part 36 of the restriction is cut free from the remaining part 37 of the restriction. The locator enters the opening 5 (shown in FIG. 3) and is forced further into the opening while cutting, and the collecting means 16 is also forced into the opening so that the collecting means is squeezed into the opening between the rim section and the core bit.

Thus, by having the locator arranged radially offset from the centre axis, the downhole tool is able to cut out part of the restriction and bring the cut-out part to surface along with the tool, even though the valve is only half-closed.

The locator 15 and the collecting means 16 arranged within the core bit 10 are fixedly connected in FIG. 5. The second part 18 comprises a base part 19, and the locator and the base part are also fixedly connected so that when the locator stops rotating, the base part also stops rotating. The core bit comprises a ball bearing 21 arranged between the core bit 10 and the base part 19. The core bit is connected with the locator by means of a fastening means 22, such as a coupling 23 (shown in FIG. 5), a shear part 24 (shown in FIG. 9) or a spring-loaded pin 25 (shown in FIG. 6), until the threshold value is reached. The coupling may be a friction coupling or a torque coupling, the coupling being arranged between the base part and the core bit. Thus, the fastening means is arranged between the base part and the core bit. As shown in FIG. 6, the core bit has an indentation 39 for receiving the spring-loaded pin 25. The core bit 10 of FIG. 6 is not rotationally symmetric around the axis L.

In FIG. 8, the second part 18 comprises the base part 19 and a spring 20. The spring 20 is arranged between the locator 15 and the base part 19 so that the locator is allowed to move along the tool axis towards the first end of the core bit if the locator reaches the restriction before rotating further on to the opening. The locator then compresses the spring when the locator rotates as it reaches the restriction, but only until the locator hits against the rim section and is forced into the opening. The spring has an extension L4 along the tool axis L so as to spring-load the locator if the locator does not reach the opening when rotating while moving along the tool axis but reaches a part of the restriction. When the locator rotates and is forced axially along the tool axis, the locator then reaches the level of the restriction, and when moving further along the tool axis, the spring is compressed. If the locator does not enter the opening directly, the locator is then able to move towards the first end 11, compressing the spring 20, and when rotating further when reaching the opening, the locator moves into the opening, stopping its further rotation, and the threshold is reached, disconnecting the locator from the core bit. The sudden stop activates the deactivation of the fastening means 22, e.g. the shear pin in FIG. 9 is broken, and the core bit continues rotating.

The indentation 39 engages with the spring-loaded pin 25 in FIG. 6 until the threshold is reached, and the pin is then forced out of the indentation 39, and the spring 20 forces the locator to be slightly offset along the tool axis so that the pin 25 is no longer able to engage the indentation.

The core bit 10 has a centre axis L2 coincident with the tool axis L, as shown in FIG. 5, and the collecting means is arranged radially offset from the centre axis so that the collecting means is able to enter the opening which is created by the half-closed valve and which is also offset of the tool axis.

In FIG. 6, the collecting means comprises a plurality of bendable parts 26 for engaging the cut-out part 36 (illustrated in FIG. 5) of the restriction. The bendable parts extend radially from the locator in the form of arms. The bendable parts 26 are shaped as flexible fingers which are more flexible than the locator so that when the locator extends into the opening, the bendable parts 26 bend to fit into the opening. By having the collecting means comprising a plurality of bendable parts, the collecting means are able to fit a variety of openings and when operating in an oil well where visibility is low and it may be difficult to measure the exact geometry of the opening. The bendable parts may be plate-shaped radially extending fingers of some type of spring steel as shown in FIG. 9, and distance elements 53 are arranged in between the plate-shaped radially extending fingers 26A (shown in FIG. 7).

The collecting means 16 extends radially from the locator 15 as shown in FIGS. 5 and 9 and has a radial extension R1 being larger than that of the opening. In FIG. 5, the collecting means comprises at least one projectable part 27 for being projected when having passed the opening for supporting the cut-out part of the restriction so as to hold the cut-out part 36 of the restriction in place between the core bit 10 and the projectable part. The projectable part 27 may be spring-loaded in order to project underneath the cut-out part of the restriction.

The collecting means 16 may extend radially all the way around the locator 15 as shown in FIG. 9 where the extension of the bendable parts/arms 26 vary so that the arms are longer towards the centre axis of the tool than opposite the core bit.

In FIG. 10, the collecting means 16 extends only partly around the locator as the collecting means 16 extends primarily from the locator towards the centre axis of the tool.

As shown in FIGS. 5 and 6, the locator 15 projects from the cutting edge 14 along the tool axis L. In this way, the locator hits the restriction first when the second part of the tool moves along the tool axis towards the restriction.

In another embodiment, the second locator end 29 of the locator has a tapering shape so as to guide the locator into the opening. The collecting means 16 could thus also be this tapering-shaped end as this end could be squeezed in between the rim section and the core bit as the core bit moves and cuts further into the restriction. The spring between the base part and the locator is thus designed to be able to be compressed accordingly so that the core bit is able to keep moving and rotating until the restriction is fully cut, separating the cut-out part 36.

When rotating, the core bit 10 cuts out a part of the restriction which occupies the space within the core bit, and the cut-out part prevents fluid within the core bit from escaping from the second end 12 of the core bit 10, and as the cut-out part moves towards the first end 11, it may displace the fluid within the space and out through apertures 45 in the first end 11, as shown in FIG. 6.

In FIG. 1, the downhole tool 1 further comprises a gearing section 31 connected between the electrical motor and the rotatable shaft 9 for reducing the rotation of the core bit in relation to a rotational output shaft 9B of the motor.

The downhole tool 1 further comprises an axial force generator 33 providing an axial force along the tool axis while rotating the core bit 10. The axial force generator is arranged in the first part 17 for moving the second part 18 in relation to the first part along the tool axis L. In order to transfer all the rotation of the motor to the core bit, the downhole tool 1 further comprises an anchoring tool section 32 for preventing the tool from rotating within the casing. The anchoring tool section comprises projectable anchoring elements.

In FIG. 4, the downhole tool 1 comprises a driving unit 34, such as a downhole tractor, for preventing the tool from rotating within the casing and for providing an axial force along the tool axis. Thus, no axial force generator or anchoring section is needed. The tool of FIG. 4 has two driving sections which are 90 degrees displaced along the circumference of the tool.

As can be seen in FIGS. 1 and 4, the downhole tool may be a wireline tool in which a wireline 43 is connected to an electronic control unit 40 for powering the motor 8. The wireline may also power a second motor 41 driving a pump 42 for providing hydraulic power to drive the anchoring section 32 and the axial force generator 33 of FIG. 1, or the driving unit 34 of FIG. 4. Thus, the driving unit 34 comprises the second motor 41 driving the pump 42 for rotating wheels 51 and projecting arms 52 onto which the wheels are arranged until the wheels abut the inner face of the well tubular metal structure. The downhole tool may also comprise a compensator 44 for providing a surplus pressure inside the downhole line separation tool, as shown in FIG. 4.

In another embodiment, the downhole tool may also comprise a second pump and an accumulating section for suction of shavings from the cutting process and into the accumulating section through the apertures 45 (shown in FIG. 6).

An axial force generator may be a stroking tool and is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing (by gravity), a driving unit such as a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole tool for removing a restriction in a well tubular metal structure having a wall and an inner diameter, the restriction partly blocking the inner diameter, creating an opening defined at least partly by a rim section of the restriction, the downhole tool having a tool axis and comprising:

a tool body having a first part and a second part, an electrical motor arranged in the first part and configured to rotate a rotatable shaft, and a core bit arranged in the second part and having a first end connected with the rotatable shaft and a second end having a cutting edge, wherein the second part of the downhole tool further comprises:

a locator configured to locate the rim section, and a collector, wherein the locator and the collector are configured to rotate with the core bit until the locator locates the rim section and a threshold value is reached, and wherein the locator and the collector are configured to be disconnected from the rotation of the core bit when the threshold value is reached.

2. A downhole tool according to claim 1, wherein the locator and the collector are fixedly connected and configured to guide the collector in through the opening arranged off-centre from the tool axis.

3. A downhole tool according to claim 1, wherein the core bit has a centre axis, and the locator is arranged radially offset from the centre axis.

4. A downhole tool according to claim 1, wherein the locator and the collector are arranged within the core bit.

5. A downhole tool according to claim 1, wherein the second part comprises a base part, and a spring arranged between the locator and the base part so that the locator compresses the spring when moving along the tool axis towards the first end of the core bit.

6. A downhole tool according to claim 5, wherein the locator and the base part are fixedly connected.

7. A downhole tool according to claim 1, wherein the core bit is connected with the locator by a fastener until the threshold value is reached.

8. A downhole tool according to claim 1, wherein the core bit has a centre axis, and the collector is arranged radially offset from the centre axis.

9. A downhole tool according to claim 1, wherein the collector comprises at least one bendable part for engaging the cut-out part of the restriction.

10. A downhole tool according to claim 1, wherein the locator projects from the cutting edge along the tool axis.

11. A downhole tool according to claim 1, wherein the locator has a first locator end connected with the core bit and a second locator end having a tapering shape.

12. A downhole tool according to claim 1, wherein the collector extends radially from the locator.

13. A downhole tool according to claim 1, further comprising an axial force generator providing an axial force along the tool axis.

14. A downhole tool according to claim 1, further comprising an anchoring tool section for preventing the tool from rotating within the casing.

15. A downhole tool according claim 1, further comprising a drive unit configured to prevent the tool from rotating within the casing and configured to provide an axial force along the tool axis.

16. A downhole tool according claim 15, wherein the drive unit comprises a downhole tractor.

17. A downhole tool according to claim 7, wherein the fastener includes a coupling, a shear part or a spring-loaded pin.

* * * * *